United States Patent [19]

Malick

[11] Patent Number: 4,481,405

[45] Date of Patent: Nov. 6, 1984

[54] COOKING APPLIANCE

[76] Inventor: Franklin S. Malick, 518 Greenleaf Dr., Monroeville, Pa. 15146

[21] Appl. No.: 489,095

[22] Filed: Apr. 27, 1983

[51] Int. Cl.[3] ..... H05B 1/02

[52] U.S. Cl. ..... 219/405; 219/411; 219/343; 219/412; 99/334; 99/331

[58] Field of Search ..... 219/354, 405, 411, 343, 219/342, 412, 414, 509, 535, 543, 10.77; 99/325, 331, 332, 334, 326

[56] References Cited

U.S. PATENT DOCUMENTS

| | | | |
|---|---|---|---|
| Re. 24,296 | 3/1957 | Stewart | 219/405 |
| 1,465,508 | 8/1923 | Carpenter | 99/334 |
| 1,919,050 | 7/1933 | Warner | 99/331 |
| 2,163,816 | 6/1939 | Vidaver | 99/334 |
| 2,212,794 | 8/1940 | Salinski | 99/331 |
| 2,590,580 | 3/1952 | Schiavone | 219/10.77 |
| 2,864,932 | 12/1958 | Forrer | 219/405 |
| 3,037,443 | 6/1962 | Newkirk | 219/411 |
| 3,280,720 | 10/1966 | Kuhn | 219/411 |
| 3,368,063 | 2/1968 | Kuhn | 219/405 |
| 3,531,300 | 9/1970 | Greenberg | 99/325 |
| 3,548,146 | 12/1970 | Hoyland | 219/354 |
| 4,151,791 | 5/1979 | Baker | 219/405 |
| 4,249,067 | 2/1981 | Cummings | 219/405 |

*Primary Examiner*—C. L. Albritton
*Assistant Examiner*—Teresa J. Walberg
*Attorney, Agent, or Firm*—Thomas H. Murray

[57] ABSTRACT

A cooking appliance, particularly adapted to heat boilable pouch packaged foods, employing incandescent electric lamps as a radiant heat source. Cooking is controlled without a timer by sensing expansion of the plastic pouch containing the food. Venting is employed which permits the appliance to be extremely compact while permitting the use of decorative wooden end panels which will not overheat.

16 Claims, 7 Drawing Figures

COOKING APPLIANCE

BACKGROUND OF THE INVENTION

In the past, cooking ovens have been devised which employ tungsten-filament electric light bulbs for heating. Some of these, such as those described in U.S. Pat. Nos. 3,368,063 and 4,249,067 comprise toys and are not suitable for practical kitchen use. Others, such as that shown in U.S. Pat. No. 1,630,237, employ light bulbs above and below an object to be cooked, but are cumbersome and are not altogether practical.

The present invention is particularly adapted for use in heating pre-packaged foods contained in sealed, plastic pouches. Such foods normally include vegetables, soups and the like which are pre-packaged and sold frozen. The food may be fresh-frozen or precooked. In order to heat the food, ordinarily it is necessary to immerse it, while in its plastic pouch, in boiling water or it can be heated in a microwave oven. It is not possible or practical to heat such pouches in a conventional oven or on a grill since the plastic pouch will melt at temperatures above about 250° C. As the food heats, steam is generated which expands the plastic pouch; and in the case of microwave heating, the pouch must be ruptured to permit the steam to escape to prevent rupture during the heating process. In the case where food within the pouch is precooked, water is usually brought to a boil (a period of at least 5 minutes) followed by immersion of the pouch in the boiling water for at least 18 minutes. Uncooked foods, of course, take longer.

SUMMARY OF THE INVENTION

In accordance with the present invention, a new and improved cooking appliance is provided, employing conventional tungsten-filament incandescent light bulbs as heat sources, which is particularly adapted for use in heating boil-in-the-bag packaged foods. The appliance is small and compact, increases cooking speed, is of high efficiency with attendant energy savings, and has a high degree of safety because of its low surface temperature. At the same time the appliance is convenient to use and requires a low degree of attention. In this regard, both boiling water and microwave oven instructions call for the user to turn over or move the pouch partway through the heating process. This becomes unnecessary with the present invention.

In the preferred embodiment of the invention, energization of the incandescent lamps which supply the heat is controlled by means of a switch which is actuated as water within the sealed pouch forms steam and expands the pouch. That is. the pouch is placed on a grid; and as it expands due to the generation of steam during heating, it engages a lever which, in turn, interrupts the supply of power to the heating lamps. When this occurs, the steam within the pouch immediately begins to condense so that the pouch deflates; while the switch which was actuated by expansion of the pouch again supplies power to the lamps. This ON and OFF action continues with the lamps being ON about 1 second and OFF about 3 seconds. When cycling occurs, exactly the correct amount of heat is applied to the food to keep it at the boiling point. The food cannot burn or dehydrate as long as cycling continues. In this manner, it is known that the cooking process is proceeding normally when cycling begins. The need for a timer to prevent scorching or dehydration is eliminated.

Further features of the invention include venting of the cooking compartment to permit its end panels to remain cool with a shorter overall length than is required when the cooking compartment is not ventilated. This permits the end panels to be formed from wood which provides a pleasing aesthetic appearance of the cooking appliance. Venting the compartment also lowers the temperature of the air, the lamp glass and the support grid and thereby improves reliability by reducing the possibility of damage to the plastic pouch. However, should permissible temperatures be exceeded, a thermostat will automatically interrupt the supply of power to the heating lamps and prevent overheating of the switches if the oven is left ON for a long period with no food in it. Light labyrinths are provided adjacent the aforesaid vents which prevent any possibility of a direct view through the vent onto any illuminated interior surface of the cooking compartment. The high light levels which occur within the cooking compartment without a properly designed labyrinth cause spots before the eyes and are very unpleasant.

In contrast to conventional ovens where the food is heated by hot air or long-wave infrared radiation, the present invention heats the food by short-wave infrared radiation. The switch which senses expansion of the pouch in the present invention cannot be used in such conventional ovens since the stored heat in the heating elements will continue to cause the pouch to expand and rupture it even though the power is turned OFF. In this respect, the air within the cooking compartment of the present invention is below the boiling point, somewhat similar to conditions existing in a microwave oven. At the same time, dehydration of the food and overcooking cannot occur as it might in a microwave oven, meaning that there is no reason to end the cooking at an exact time, as with a timer. The user simply removes the food from the oven whenever he is ready.

The above and other objects and features of the invention will become apparent from the following detailed description taken in connection with the accompanying drawings which form a part of this specification, and in which.

Figure 1:
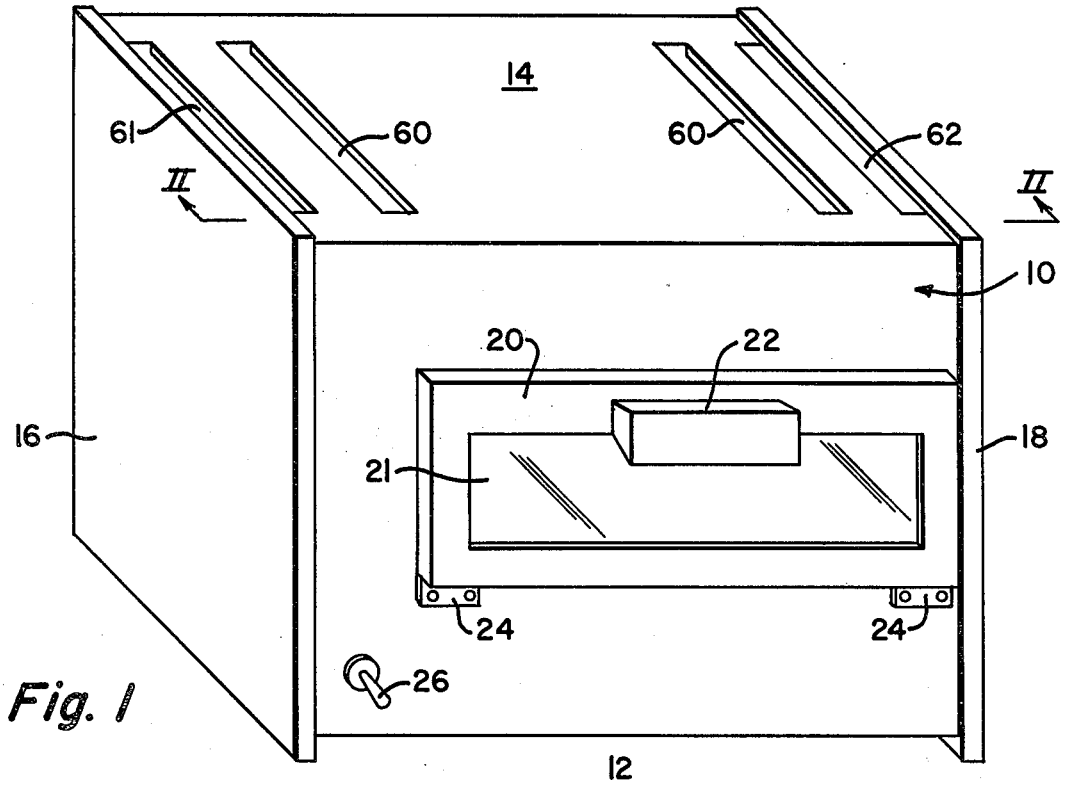
FIG. 1 is a perspective front view of the cooking appliance of the invention.

With reference now to the drawings, and particularly to FIG. 1, the cooking appliance shown includes an outer cabinet 10 having a front wall 12, a top wall 14 and end walls 16 and 18. Bottom and back walls, not shown in FIG. 1, are also provided. In the front wall 12 is an opening provided with a door 20 provided with a handle 22. The door 20 is hinged to the front wall 12 by means of suitable hinges 24 as shown in order that the handle 22 may be grasped and the door 20 rotated outwardly and downwardly to expose the interior of the cooking appliance. Door 20 is provided with a one-way reflecting mirror window 21 (FIGS. 1 and 5) which permits viewing the pouch at a comfortable light level but which also prevents the leakage of radiant energy. End walls 16 and 18 are preferably formed from decorative wood to improve the aesthetic appearance of the appliance. Using wooden end walls in an appliance, as will be appreciated, is highly unusual and is facilitated only by the features of the present invention, about to be described. An ON-OFF switch 26 is provided on the front wall 12 as shown in FIG. 1.

Figure 2:
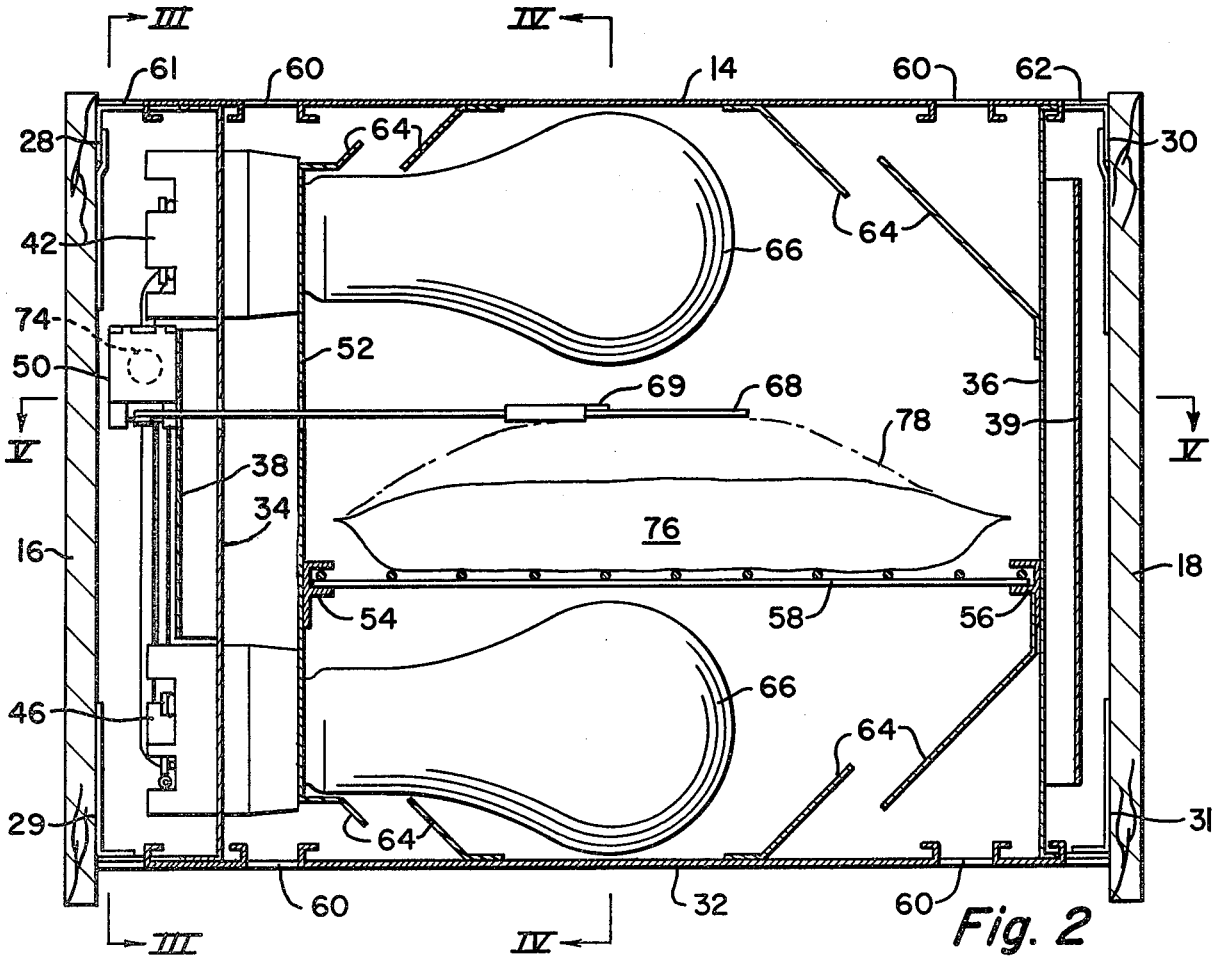
FIG. 2 is a cross-sectional view taken substantially along line II—II of FIG. 1 showing the interior of the cooking compartment.
Figure 3:
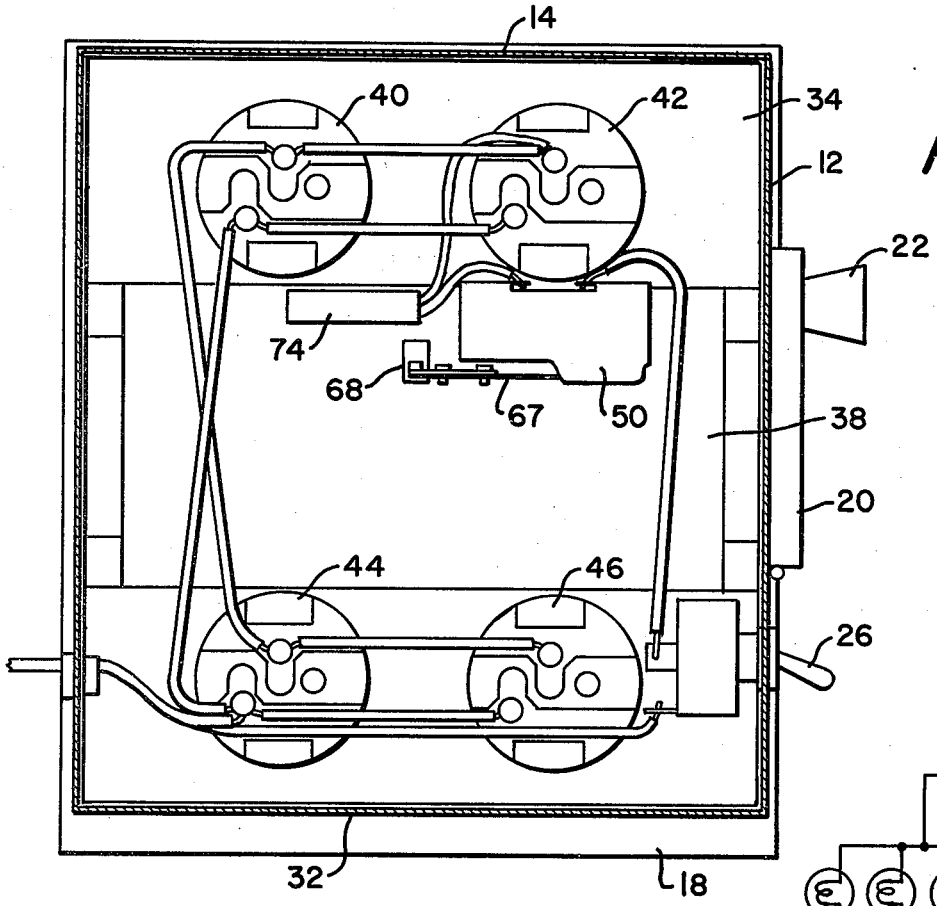
FIG. 3 is a cross-sectional view taken substantially along line III—III of FIG. 2 showing the positioning of the heating lamp sockets and ON-OFF switch therefor.
Figure 5:
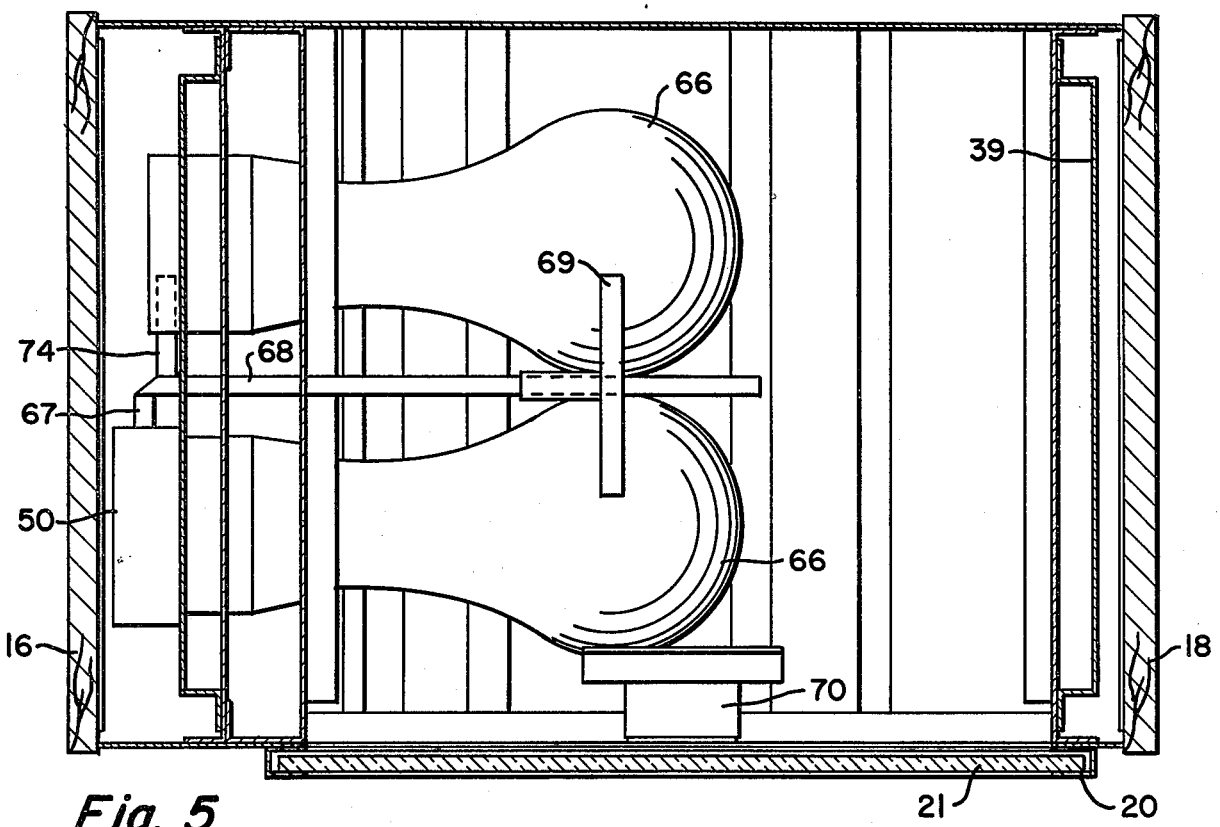
FIG. 5 is a cross-sectional view taken along line V—V of FIG. 2.

With reference now to FIG. 2, cabinet 10 includes the upper wall 14 connected at its ends through brackets 28 and 30 to the wooden end walls 16 and 18. Similarly, the bottom wall 32 of the enclosure is connected at its opposite ends to the wooden end walls 16 and 18 through brackets 29 and 31. Spaced from the end wall 16 is an interior wall 34 formed from sheet metal; and, similarly, spaced from the end wall 18 is a second interior wall 36 also formed from sheet metal and connected at its upper and lower ends to the top and bottom walls 14 and 32. Spaced from the interior wall 34 is a second interior wall 38 secured at its sides to the wall 34. Wall 34 has openings extending therethrough (FIG. 3) which support four lamp sockets 40, 42, 44 and 46. Additionally, wall 38 supports a microswitch 50 and thermostat 74 (FIG. 5). Supported on the wall 34 is a wall or bracket 52 (FIG. 2) having a channel member 54 secured thereto. The wall 52 acts primarily as a light reflector to shield wall 34 from the radiation from the lamps and lower its temperature. Similarly the interior wall 36 at the other end of the cabinet has a channel member 56 secured thereto, the two channel members 54 and 56 supporting a grid 58 which is 7-½" wide by 7" deep.

Figure 4:
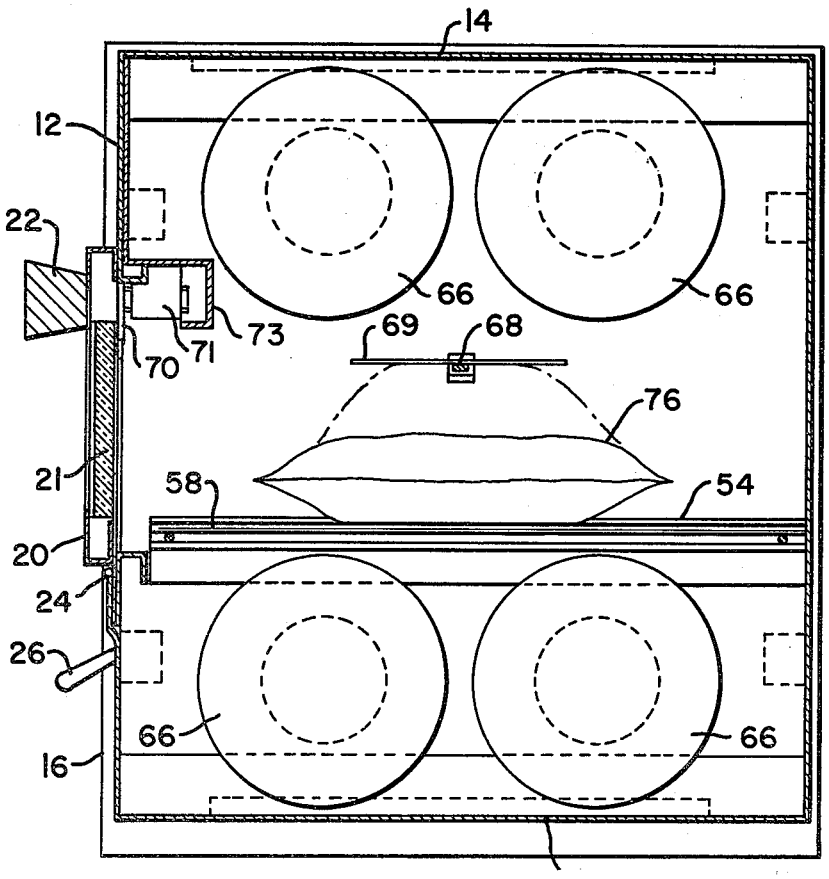
FIG. 4 is a cross-sectional view taken along line IV—IV of FIG. 2.

Punched into the top and bottom walls 14 and 32 at the opposite ends of the cabinet are vent openings 60. These provide ventilation at the opposite ends of the cooking compartment to reduce the a1r temperature in the cooking compartment and to help prevent overheating of the wooden end walls 16 and 18 and the microswitch 50. In order to prevent light from escaping through the vents 60, labyrinths are formed from sheet metal brackets 64 which permit circulation of air while preventing light from passing through the vents 60. All of the interior surfaces of the walls shown in FIG. 2 are reflective except those in the labyrinth which are painted black. Four 200-watt incandescent lamps 66 are screwed into the sockets 40–46 such that two of the lamps are above the grid 58 while two are below it. The operating lever 67 (FIG. 3) on switch 50 is provided with a right-angle elongated extension 68 (FIG. 5) which extends over the grid 58 as shown. The angle in the extension permits the long dimension of the switch to be mounted on wall 38, thus shortening the appliance by 1-½ inches. A clip extension 69 in the form of a cross or grid can be slipped over the forward end of the extension 68 such that the pouch will not swell up on either side of the lever and contact the glass of the lamps with the possible result of a melted hole in the pouch. Handle 22 on door 20 (FIG. 4) is provided with a magnetic latch plate 70 as shown. Bracket 73 which supports magnet 71 is bent to shield the magnet from heat from the lamps. Also in the top and bottom walls 14 and 32 at opposite ends of the cabinet are vent openings 61 and 62. Vent opening 61 provides ventilation of the space between wall 34 and the wooden end panel 16 and, therefore, cools the panel, the switch support wall 38, the microswitch and the lamp sockets. Vent opening 62 provides ventilation of the space between wall 36 and the wooden end panel 18 and, therefore, cools the panel and radiation shield 39 which is supported at its sides on wall 36. Vent 61 also permits the use of a microswitch 50 rated for low temperature operation as contrasted with the more expensive high temperature types. The switch is the most expensive single component in the oven; and a means for keeping it at lower temperatures is, therefore, of prime importance.

Figure 6:
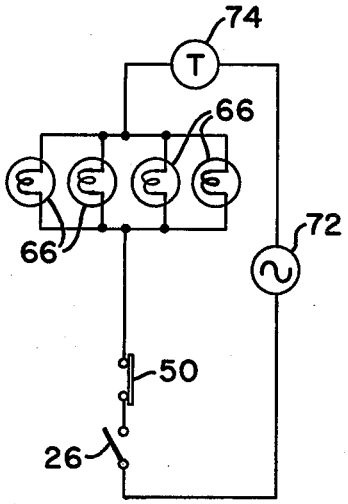
FIG. 6 is a simplified schematic circuit diagram of the control circuit for the cooking appliance of the invention.

With specific reference to FIG. 6, an electrical schematic for the cooking appliance of the invention is shown. It includes a power source 72 connected in series with the two switches 26 and 50, the four lamps 66 in parallel and a thermostat 74. Thermostat 74 is carried on wall 38 adjacent switch 50. When switch 26 is closed, power is supplied to the lamps 66 and will continue to be supplied until the switch 26 is opened or the normally-closed microswitch 50 opens when extension 68 is moved upwardly. Thermostat 74 insures that in the event of an overheating condition, power will be disconnected from the lamps 66.

In the operation of the appliance of the invention, a plastic pouch 76 (FIG. 2) containing food to be cooked is placed on the grid 58 and the door 20 is closed. Thereafter, switch 26 is closed to energize the lamps 66. The infrared radiation from the lamps 66 heats the contents of the plastic pouch 76; and as it does so, steam is generated within the pouch 76 which causes it to inflate to the approximate position shown by the dotted line 78 in FIG. 2. At this point, the pouch forces the extension 68 upwardly, thereby opening switch 50. When switch 50 opens, the lamps 66 become deenergized, whereupon steam within the pouch 76 condenses, the extension 68 lowers and the switch 50 is again closed to supply power to the lamps 66. This ON and OFF condition of the lamps continues with the correct amount of heat being applied to the food to keep it at the boiling point without scorching or dehydration as long as cycling continues.

When the desired cooking time has been reached, the switch 26 on the forward wall 12 is turned OFF. The pouch 76 can then be removed by grasping the thin edge of the pouch and pulling it out of the oven and onto a plate or serving dish. Continued cycling, which is very noticeable from the switch clicking and the light flashing, is an excellent indication of the progress of cooking. How long the food should cycle runs from 5 to 15 minutes depending upon whether the food is precooked or fresh.

The cooking appliance of the invention can also be used to bake potatoes, rolls or biscuits just as in a standard oven. In this case, of course, a pouch is not used. Potatoes or biscuits, for example, can be placed anywhere in the enclosure as long as the pouch-sensing switch is not actuated. Finally, the applicance can be used to heat frozen TV dinners. Again, a pouch is not necessary; although the top aluminum cover on the TV dinner should be removed. A TV dinner will cook in the appliance of the invention in about half the time required in a standard oven.

By virtue of the fact that the lamps 66 are mounted at only one end of the enclosure, the appliance can be made shorter and less expensive, in contrast with an arrangement where the lamps are mounted at both ends of the enclosure.

Figure 7:
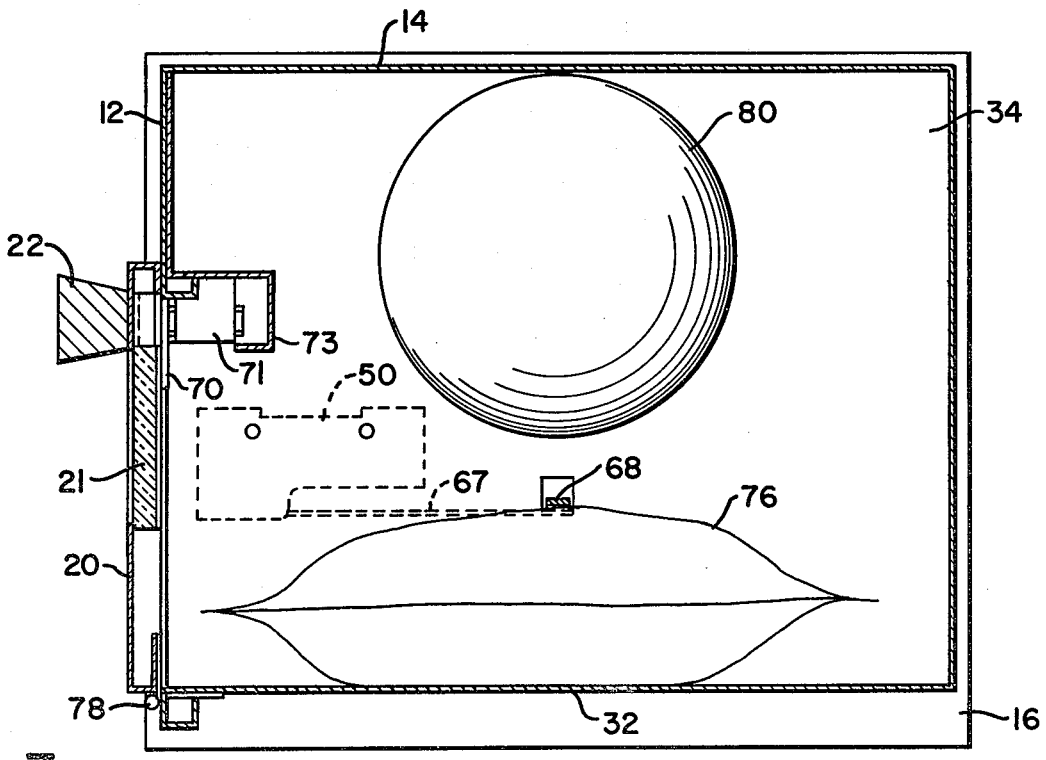
FIG. 7 illustrates a modified, simple embodiment of the invention.

In FIG. 7 a smaller, simplified embodiment of the invention is shown wherein elements corresponding to those of the preceding figures are identified by like reference numerals. In this case, however, the grid 58 is eliminated and the pouch 76 simply rests on the bottom wall 32. Additionally, the door 20 is hinged at 78 to the bottom of the front wall 12 to permit the pouch to slide beneath switch extension 68. Only a single 300-watt lamp 80 is employed and is screwed into a socket (not shown) mounted on interior wall 34. Wall 34 also supports switch 50 as in the previous embodiment. Aside from this, the operation of the invention is the same. When lamp 80 is energized, the pouch 76 inflates and, through extension 68, opens switch 50 to deenergize the lamp; whereupon the pouch deflates and the cycle repeats.

Although the invention has been shown in connection with a certain specific embodiment, it will be readily apparent to those skilled in the art that various changes in form and arrangement of parts may be made to suit requirements without departing from the spirit and scope of the invention.

I claim as my invention:

1. Apparatus for heating food sealed within a plastic pouch which comprises an enclosure, a grid within said enclosure on which said pouch is positioned for cooking, incandescent electric lamps within said enclosure, means for supplying a source of power to said lamps, and switch means actuable by expansion of said pouch by steam generated by heat from the lamps for disconnecting the power source from said lamps, said switch means being actuable by deflation of said pouch upon condensation of the steam to again connect said power source to said lamps, whereby repeated connection and disconnection of the power source will maintain a steam atmosphere required for cooking.

2. The apparatus of claim 1 wherein said switch means includes lever means extending over said grid and said pouch, the lever means being forced upwardly by expansion of the pouch to open the switch means and disconnect said power source from the lamps.

3. The apparatus of claim 2 wherein said switch means is mounted on a wall of said enclosure, said lever means having a portion parallel to said wall and a connecting portion overlying said pouch.

4. The apparatus of claim 3 wherein the lever is in the form of a cross at its forward end where it is in contact with the pouch.

5. The apparatus of claim 1 wherein there are four electric incandescent lamps, two above said pouch and two below.

6. The apparatus of claim 1 including vent means in said enclosure for permitting air to circulate through the enclosure.

7. The apparatus of claim 6 wherein said vent means comprise openings in a top and bottom of said enclosure at opposite ends thereof.

8. The apparatus of claim 7 including labyrinth means for preventing light from escaping through said vent means.

9. The apparatus of claim 7 wherein said enclosure has end panels formed from decorative wood, the vent means preventing overheating of the wooden panels and electrical elements within the enclosure.

10. The apparatus of claim 1 wherein said means for supplying a source of power to said lamps includes said switch means actuable by the expansion of said pouch, a manual ON-OFF switch, and a thermostat all connected in series.

11. The apparatus of claim 10 wherein the means for supplying a source of power to said lamps is independent of any timing means.

12. The apparatus of claim 10 wherein said switch means and said thermostat are carried on an interior wall within said enclosure adjacent an end wall of the enclosure.

13. The apparatus of claim 12 wherein said lamps are inserted into sockets carried on said interior wall.

14. Apparatus for heating food sealed within a plastic pouch which comprises an enclosure, electrical means within the enclosure for generating heat within the plastic pouch to heat the food therein while generating steam which expands the pouch, means for suppling a source of electrical power to said means for generating heat, and switch means actuable by expansion of said pouch by steam generated by heat from said electrical means for disconnecting the power source from said means for generating heat and for again connecting the power source to said means for generating heat when steam condenses in the pouch and the pouch deflates.

15. The apparatus of claim 1 wherein there are at least two incandescent electric lamps within said enclosure, one above said grid and one beneath said grid.

16. Apparatus for heating food sealed within a plastic pouch which comprises an enclosure, one incandescent electric lamp within said enclosure, means for supplying a source of power to said lamp, and switch means actuable by the expansion of said pouch by steam generated by heat from said lamp for disconnecting the power source from said lamp and for again connecting the power source to said lamp when steam condenses in the pouch and the pouch deflates.

* * * * *